US005555947A

United States Patent [19]

Bunker et al.

[11] Patent Number: 5,555,947

[45] Date of Patent: Sep. 17, 1996

[54] MOLE LAUNCHER AND A METHOD OF OPERATING A MOLE LAUNCHER

[75] Inventors: Roger S. A. Bunker, Witney; David J. Goodall, Bursledon, both of Great Britain

[73] Assignees: British Gas, London; Bonuscentre Limited, Minster Lovell, both of Great Britain

[21] Appl. No.: 446,850

[22] PCT Filed: Dec. 3, 1993

[86] PCT No.: PCT/GB93/02499

§ 371 Date: Aug. 9, 1995

§ 102(e) Date: Aug. 9, 1995

[87] PCT Pub. No.: WO94/13926

PCT Pub. Date: Jun. 23, 1994

[30] Foreign Application Priority Data

Dec. 4, 1992 [GB] United Kingdom ..... 9225466
Mar. 3, 1993 [GB] United Kingdom ..... 9304259

[51] Int. Cl.[6] ..... E21B 7/02

[52] U.S. Cl. ..... 175/62; 173/150; 173/156; 173/189; 175/122; 175/162

[58] Field of Search ..... 175/162, 122, 175/220, 62; 173/150, 156, 189, 185

[56] References Cited

U.S. PATENT DOCUMENTS

| | | | |
|---|---|---|---|
| 825,857 | 7/1906 | Moran et al. | 173/150 |
| 2,969,121 | 1/1961 | Wallace | 175/220 |
| 3,451,491 | 6/1969 | Clelland | 175/62 X |
| 3,682,253 | 8/1972 | McIntosh et al. | 173/189 |
| 4,181,182 | 1/1980 | Gustafsson | 173/189 |
| 4,732,222 | 3/1988 | Schmidt | 175/22 |
| 4,953,638 | 9/1990 | Dunn | 175/162 X |
| 4,958,689 | 9/1990 | Lee | 175/19 |

FOREIGN PATENT DOCUMENTS

| | | | |
|---|---|---|---|
| 0147095 | 7/1985 | European Pat. Off. . | |
| 1592509 | 6/1970 | France . | |
| 275884 | 6/1914 | Germany . | |
| 840334 | 6/1981 | U.S.S.R. | 175/122 |
| 1521974 | 8/1978 | United Kingdom . | |
| 2179280 | 3/1987 | United Kingdom . | |
| WO91/14851 | 10/1991 | WIPO . | |

*Primary Examiner*—Hoang C. Dang
*Attorney, Agent, or Firm*—Larson & Taylor

[57] ABSTRACT

A mole launcher which has a hydraulically powered, double-acting piston and cylinder unit to push or pull a slider. The slider carries a drill head connected to a drill string. The other end of the drill string carries a mole to bore an underground passage. By releasably locking the slider to the front of the launcher, the cylinder can be moved between a first position in which it projects beyond the chassis of the launcher, and a second position in which it is placed only within the length of the chassis. Thus, the mole launcher is considerably shorter in its transportation state than in its operating state.

28 Claims, 4 Drawing Sheets

MOLE LAUNCHER AND A METHOD OF OPERATING A MOLE LAUNCHER

This invention concerns a mole launcher from which is propellable under fluid power a string of drill pipes having at an end of the string remote from the launcher a mole operable to bore an underground passage.

The invention also concerns a method of operating a mole launcher.

The aforesaid passage may be bored to receive, for example, an underground pipe or cable.

The string of drill pipes may be used to supply power therethrough to actuate the mole for it to perform passage boring operations.

Moles are known in which the mole operates percussively to bore the passage in response to fluid power, for example pneumatic power, applied to the mole through the string of drill pipes which is connected to the mole and is pushed along the passage behind the mole by fluid power, for example hydraulic power.

An object of the invention is to provide a mole launcher capable of being constructed to provide a powerful fluid powered thrust acting on the string of drill pipes in the direction of boring and also capable of providing a powerful extraction force for pulling the string from the bored passage.

Another object of the invention is to provide a mole launcher capable of being constructed so that in its transportation state it can be considerably shorter than when it is in its operating state for pushing or pulling on a string of drill pipes.

According to a first aspect of the invention there is provided a mole launcher from which is propellable under fluid power a string of drill pipes having at an end of the string remote from the launcher a mole operable to bore an underground passage, said mole launcher comprising support means, a double acting fluid powered piston and cylinder unit comprising a cylinder having a piston working therewithin and acting to reciprocate a connecting rod as said piston reciprocates, said cylinder being mounted on said support means and being capable of longitudinal movement relative to the support means, connecting means for detachably connecting the connecting rod to a said drill pipe at an end of a said drill pipe string when the launcher is in use and the mole is at the other end of the string such that when the connecting rod performs linear strokes relative to the cylinder the linear movement of the rod is applied as linear movement to the drill pipe string which is pushed or pulled by said movement of the connecting rod, said cylinder being movable longitudinally relative to the support means between first and second positions, first disengageable restraining means for holding the connecting rod substantially stationary relative the said support means whereby under fluid power the cylinder can be moved from said first position to said second position and vice-versa, second disengageable restraining means for holding the cylinder substantially stationary longitudinally in said second position whereby under fluid power applied to the cylinder said connecting rod can be reciprocated relatively to the cylinder such that on an outward movement from the cylinder said connecting rod exerts pushing force on the string of drill pipes connected to the connecting rod in the course of use of the launcher.

The cylinder, when in said second position, may project beyond said support means and disengageable engagement means may be provided on the cylinder and said support means to restrain and support the cylinder from lifting away from said support means.

While moving between the first and second positions the cylinder may be slidably supported by a guide on the support means.

Said connecting means for connection to a drill pipe may be mounted on a slider slidably mounted on the support means and said connecting rod may be attached to said slider. The connecting means may be movable relative to the slider in opposite directions along which the slider is movable by said connecting rod.

Said slider may be in sliding engagement with said support means.

The support means may be tiltable, relative to the ground, by operation of fluid pressure actuated jack means.

The mole launcher may be provided with detachable mechanical restraining means to oppose widening of an angle at which the support is tilted.

According to a second aspect of the invention there is provided a method of operating a mole launcher intended for at least pushing a string of drill pipes behind a mole boring a passage in the ground, said method comprising providing a mole launcher comprising a chassis on which is slidably mounted a drill head which is detachably attachable to said string, and a double acting hydraulic piston and cylinder unit slidably mounted on the chassis and having a connecting rod to pull and push said drill head, disengageably engaging the drill head with the chassis at a first position along the chassis by disengageable first engaging means to hold the drill head at said first position, applying hydraulic pressure to said unit to move the cylinder along the connecting rod and chassis in a first direction to a second position along the chassis, said first and second positions being spaced apart, disengageably engaging the cylinder of said unit with the chassis at said second position, moving the first engaging means to disengage the drill head from the chassis to allow the drill head to move from said first position, and applying hydraulic pressure to the unit to retract the connecting rod into the cylinder and move the drill head in the first direction along the chassis towards said second position.

Each aspect of the invention will now be further described, by way of example, with reference to the accompanying drawings in which.

Figure 1:
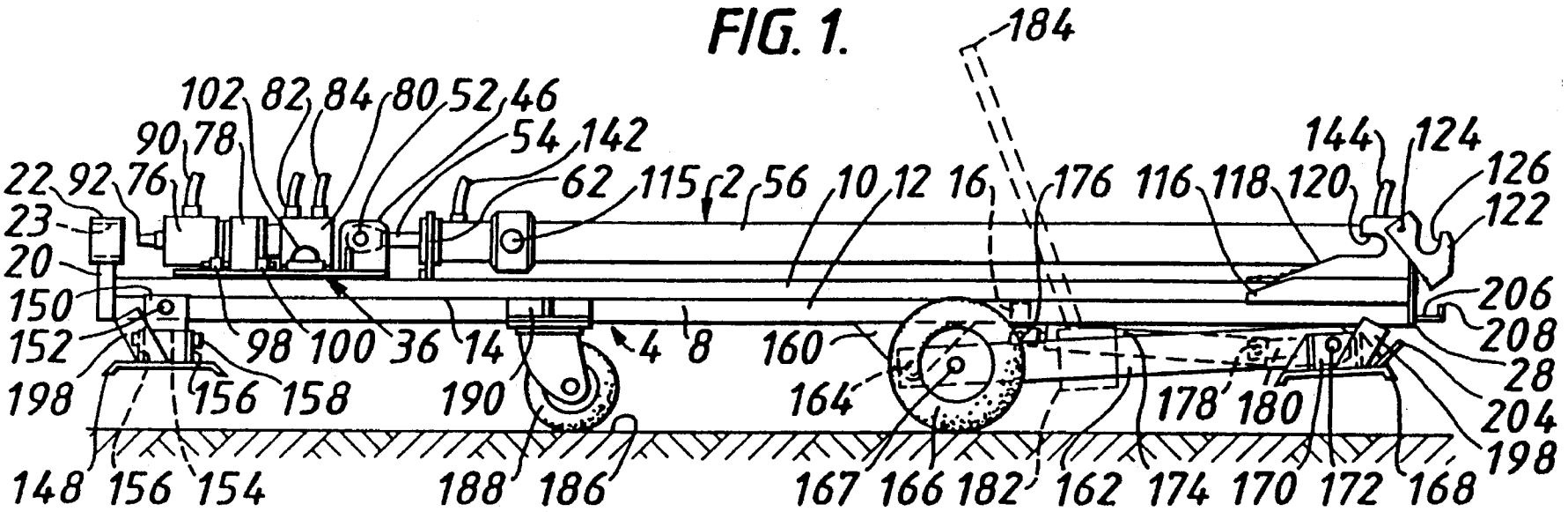
FIG. 1 is a side elevation of a mole launcher formed according to the first aspect of the invention, shown in a position for transportation, said mole launcher being capable of being operated according to the second aspect of the invention.

In the drawings a mole launcher 2 comprises a strong, sturdy support or chassis 4 formed of two longitudinal, channel-shaped side members 6 and 8 each formed of two beams 10,12 of L-section welded together at 14 along abutting edges. At intervals along the chassis 4 the side members 6,8 are tied together by hollow, strengthening beams 16 of rectangular cross-section welded thereto. At its front end the chassis 4 has front end plate arrangement 20 welded to the side members 6,8 and mounting a guide 22 having a central opening 23 through which drill rods 24 of a drill string are passed and guided. Towards its rear end the chassis 4 has a sturdy dowel plate 26 extending between the side members 6,8 and welded thereto. At its rear end the chassis 4 has a guide plate 28 welded thereacross and formed with a V-shaped guide notch 30 in its upper edge.

At the upper edge of each side member 6 or 8 is an inturned flat flange 32 or 34 forming runners along which a slide 36 can run. The slide 36 comprises an upper slide plate 38 overlying the upper sides of the runners 32 and 34, a lower slide plate 40 underlying the under sides of the runners and a spacer plate 42 sandwiched between the plates 38,40 to which it is secured. A replaceable bearing plate 44 of a relatively hard wearing low friction composite or plastics material is detachably mounted along each longitudinal edge of the upper slide plate 38 at the underside thereof and along each longitudinal edge of the lower slide plate 40 at the upper side thereof. Thus as the slide 36 is slid back and forth along the chassis 4 on the runners 32,34 the bearing plates 44 slide over the runners.

A pair of brackets 46 is securely mounted on the upper slide plate 38 at a rear end thereof and are buttressed by flanges 48. A clevis 50 is pivoted between the brackets 46 on an horizontal pivot 52; the clevis being mounted on an end of a connecting rod 54 connected to a double-acting piston (not shown) sliding in a cylinder 56 of a fluid powered double-acting piston and cylinder unit which in this example is an hydraulic piston and cylinder unit. The cylinder 56 is supported in the notch 30 by replaceable bearing blocks 58 of relatively hard wearing composite or plastics material detachably mounted on the guide plate 28. Welded around a reinforcing collar 60 on a front end of the cylinder 56 is a lock plate 62 having a depending tab portion 64 entering the space between the runners 32,34 and reinforced on one side by a welded-on plate 66 formed with a through aperture 68 coinciding with a through aperture 70 in the tab portion 64. On either side of the tab portion 64 the lock plate 62 has shoulders 72 on which replaceable bearing blocks 74 of relatively hard wearing low friction composite or plastics material are mounted to slide on the upper faces of the runners 32 and 34.

A drill-head comprising an air-box 76 (known per se), a bearing 78 and an hydraulic motor 80 (known per se) is slideably mounted on the slide 36 in front of the brackets 46.

The hydraulic motor 80, which slideably sits on the upper slide plate 38, is connected via pipes 82 and 84 with a known hydraulic power supply and control (not shown) whereby the motor can be rotatably driven to give a rotary output of variable speed as desired or be stopped. Rotary output from motor 80 is transmitted by a shaft (not shown) through the bearing 78 which provides for the shaft good resistance against displacement of the shaft in either direction along its axis relative to a casing 96 of the bearing. The shaft drives another rotary shaft portion 86 which is hollow and has a wall with through apertures 88 opening into the interior of the air-box 76 which can be supplied in known manner via a pipe 90 with compressed air which enters the shaft 86 and emerges therefrom through an externally tapering connecting tube 92 having a screw-threaded exterior.

The tube 92 is mounted to rotate with the shaft 86 when the hydraulic motor 80 is providing rotary output.

The drill-head 76,78,80 is mounted on the slide 36 by means of two parallel rails or rods 94 each passing through a respective passage in opposite sides of the bearing casing 96 between two spaced abutment faces or shoulders 95 and 97 on both said sides of the bearing casing. Each rod 94 is mounted against longitudinal movement thereof relative to the slide 36 in two spaced brackets 98 and 100 firmly mounted on the slide plate 38 on either side of the slide 36. Because the brackets 98 and 100 of each pair are spaced apart, longitudinally of the slide 36, by a distance greater than that between the shoulders 95 and 97 on either side of casing 96, the drill-head 76,78,80 can move as a unit relatively to slide 36, along the rods 94 in either the forwards or backwards direction until the shoulders 95 abut the brackets 98 or the shoulders 97 abut the brackets 100.

A locking pin 102 in the form of an inverted-U is provided on both sides of the slide 36, the depending limbs 106 of each pin being disposed in corresponding through passages 108 in a retaining block 110 affixedly mounted on the upper slide plate 38. Each passage 108 is aligned with corresponding through passages 112 in the upper and lower slide plates 38 and 40 and bearing plates 44. When the slide 36 is in its foremost position such as shown in FIG. 1 each set of aligned passages 108,112 is aligned with a corresponding passage 114 through each runner 32 and 34. Thus each locking pin 102 can be pushed down to ensure both its limbs 106 each pass through the passage 112 above the runners 32 and 34 and through the passage 114 in the runner and then through the passage 112 below the runner, thereby locking the slide 36 to the runners 32,34 to hold the slide 36 and thus the connecting rod 54 in its foremost position relative to the chassis 4. To unlock the slide 36, the locking pins 102 are extracted until their limbs 106 come out of the passages 114 in the runners.

Adjacent its front end the cylinder 56 has a pair of horizontal trunnions 115 affixedly mounted thereon.

At the rear of the chassis 4 a pair of trunnion plates 116 is firmly mounted, one each side. Each trunnion plate has a forward sloping edge 118 ramping up to a U-shaped notch 120 forming a trunnion bearing. A hook-shaped latch member 122 is pivotably mounted at 124 on each trunnion plate 116, a substantially U-shaped notch 126 being formed in each latch member. Both latch members 122 pivot separately.

A locking plate 130 is welded to a front face of the dowel plate 26 and has an aperture 132 coinciding with aperture 134 in the dowel plate. A rear end of a metal dowel 136 fits into the apertures 132,134 and is locked in place by a removable grub-screw 138 in the locking plate 130 which allows the dowel to be replaced should it become worn. At its front end the dowel 136 has a tapered nose 140.

The double acting cylinder 56 has inlet/outlet lines 142 and 144 connected to a supply and control system (not shown) for supplying hydraulic fluid under pressure to the cylinder as desired.

Figure 4:
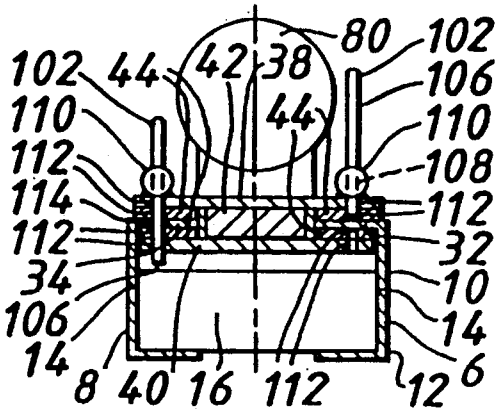
FIG. 4 is a diagrammatic cross-sectional view of the mole launcher in FIGS. 1 to 3 showing on the left-hand side of FIG. 4 aforesaid first restraining means in an engaged restraining position and showing on the right-hand side of FIG. 4 aforesaid first restraining means in a disengaged non-restraining position.
Figure 5:
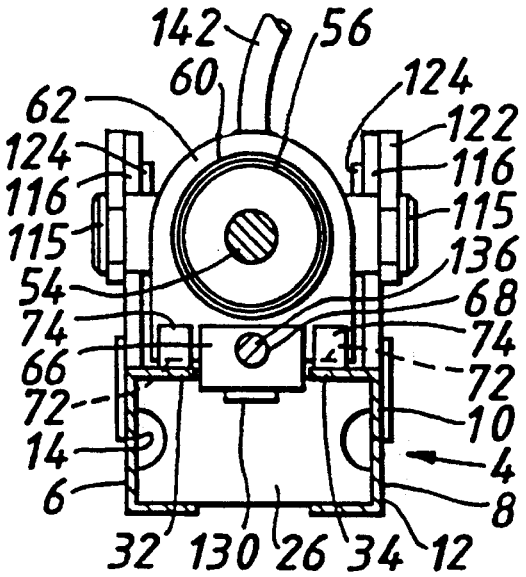
FIG. 5 is a section on line V—V in FIG. 3, with parts omitted.
Figure 6:
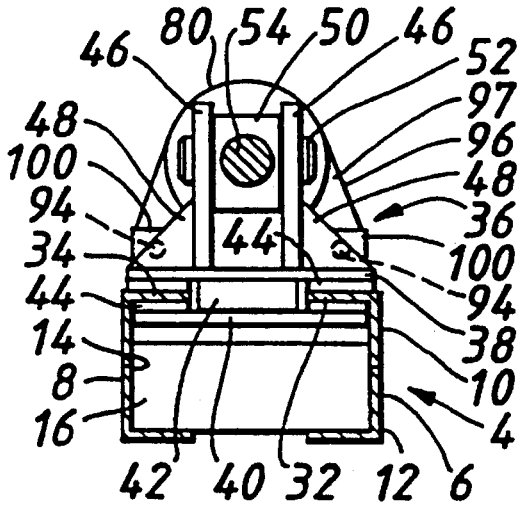
FIG. 6 is a section on line VI to VI in FIG. 3, with parts omitted.
Figure 7:
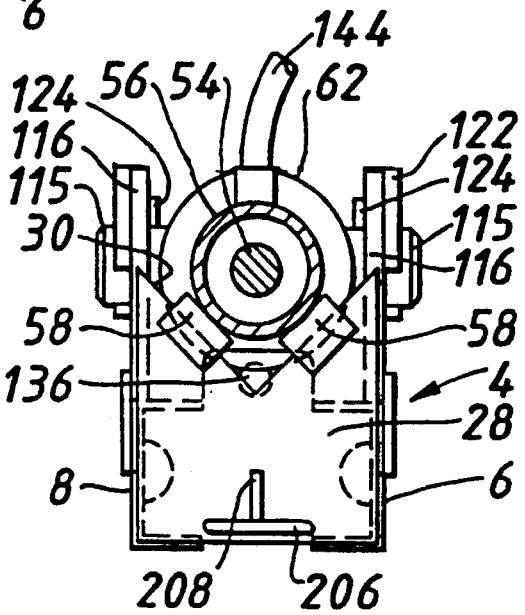
FIG. 7 is an elevation in the direction of arrow A in FIG. 3, partly in section, and with parts omitted.

When the slide 36 is at the front end of the chassis 4 similar to as shown in FIG. 1 with the locking pins 102 in place (as on the left-hand side of FIG. 4) locking the slide to the chassis, then if hydraulic pressure is applied on line 144 to the cylinder 56 and line 142 is an outlet then the cylinder moves to the right in FIG. 1 relatively to its piston and the connecting rod 54 restrained stationary by the locking pins. As the cylinder moves between its frontmost position and a rearmost position the bearing blocks 74 (FIG. 5) at the front end of the cylinder 56 run on the runners 32,34 and prevent the cylinder (slidably supported and guided by the bearing blocks 58 in the guide notch 30) from skewing or rotating about its axis. Such skewing is also resisted by the presence of the tab portion 64 and its reinforcing plate 66 between the runners (see FIG. 5). Because skewing is opposed the two trunnions 115 are maintained substantially square-on to the notches 120 (trunnion bearings) and uppermost portions of the ramps 118 of the trunnion plates 116, so as to increase the chance of the trunnion 115 entering the trunnion bearings 120 relatively cleanly and smoothly. This clean entry into the notches 120 is also assisted by the fact that just before the trunnions 115 enter the notches 120, the stationary dowel 136 starts to enter the moving apertures 68,70 at the front end of the cylinder 56. The dowel 136 also serves to guide the path of cylinder 56 and its trunnions 115 and simultaneously acts to hold the cylinder to the chassis 4 to prevent the cylinder 56 tipping backwards. Such backwards tipping is a potential risk due to the possibility of the trunnions 115 pivoting in the trunnion bearings 120 in response to the weight of the cylinder 56 extending beyond and overhanging the rear end of the chassis 4. The stroke of the piston and cylinder unit comprising the cylinder 56 is such that the rearward movement of the cylinder ceases just before (say for example 1 mm before) the trunnions 115 meet the closed back of the notches 120. This avoids hydraulic force being applied to the trunnion plates 116 at this stage. Once the trunnions 115 are in the notches 120 the trunnions can be restrained or locked therein by pivoting the latch members 122 (anti-clockwise in FIG. 1) and lowering the latch members to hold the trunnions in the notches; this may require the latch members 122 to be hammered into position.

Now with the front end of the cylinder 56 locked to the rear end of the chassis 4, the locking pins 102 can be pulled out of the apertures 114 in the runners 32,34. By supplying hydraulic pressure on line 142 and using line 144 as an outlet, the connecting rod 54 is retracted by hydraulic force into the cylinder 56 so that the slide 36 and drill-head 76,78,80 can be pulled along the chassis 4 to their rearmost position (similar to that shown in FIG. 2) adjacent to the rear of the chassis. And by supplying hydraulic pressure on line 144 and using line 142 as an outlet hydraulic force on the piston extends the connecting rod 54 from the cylinder 56 pushing the slide 36 and drill head 76,78,80 back to its foremost position. Thus the slide 36 and drill head can be reciprocated back and forth along the chassis 4 by hydraulic force whilst the cylinder 56 is locked to the trunnion plates 116.

Adjacent to its front end the chassis 4 has a plate or front foot 148 of substantially rectangular shape extending transversely to the longitudinal axis of the chassis and extending below the chassis and beyond each side of the latter. Two legs 150 (only one shown FIG. 1 and 2) are mounted one each side of the chassis 4 to freely pivot at 152 on the side members 6 and 8, the pivot 152 extending at substantially 90° to the longitudinal axis of the chassis. A transverse strut 154 extends between the legs 150 and is securely affixed thereto. At substantially its mid-length the foot 148 has a pair of upright spaced brackets 156 each disposed on opposite sides of the strut 154 and freely pivoted thereto at 158. Pivot axis 158 is substantially parallel to the axis of the chassis 4 and thus at substantially 90° to the pivot axis 152. Because the foot 148 can pivot about the two axes 152,158 it can more easily adjust to the surface of uneven ground when applied thereagainst as will be described below.

Towards the rear end of the chassis 4 two spaced brackets 160 (only one shown FIGS. 1 and 2) are mounted one on each of the side members 6 and 8. A respective leg 162 is pivotably mounted at 164 on each bracket 160 and each of the two legs has a respective ground running wheel 166 with an axle 167 mounted thereon; each wheel being beyond the adjacent side member 6 or 8. A plate or rear foot 168 of substantially rectangular shape extends transversely to the longitudinal axis of the chassis 4 and extends below the chassis and beyond each side of the latter. Adjacent to each end of the foot 168 is a respective upright bracket 170 (only one shown). Between the two spaced brackets 170 and mounted thereon is a rod 172 forming a pivot about which the foot 168 can freely pivot about an axis at substantially 90° to the axis of the chassis 4. This pivot rod 172 is mounted on both legs 162. An hydraulic piston and cylinder unit or jack 174 is disposed between the two legs 162. At one end the jack 174 is pivotably mounted at 176 on one of the strengthening beams 16. At its other end the jack 174 is pivotably mounted at 178 on a cross-strut 180 extending from one of the two legs 162 to the other.

Figure 2:
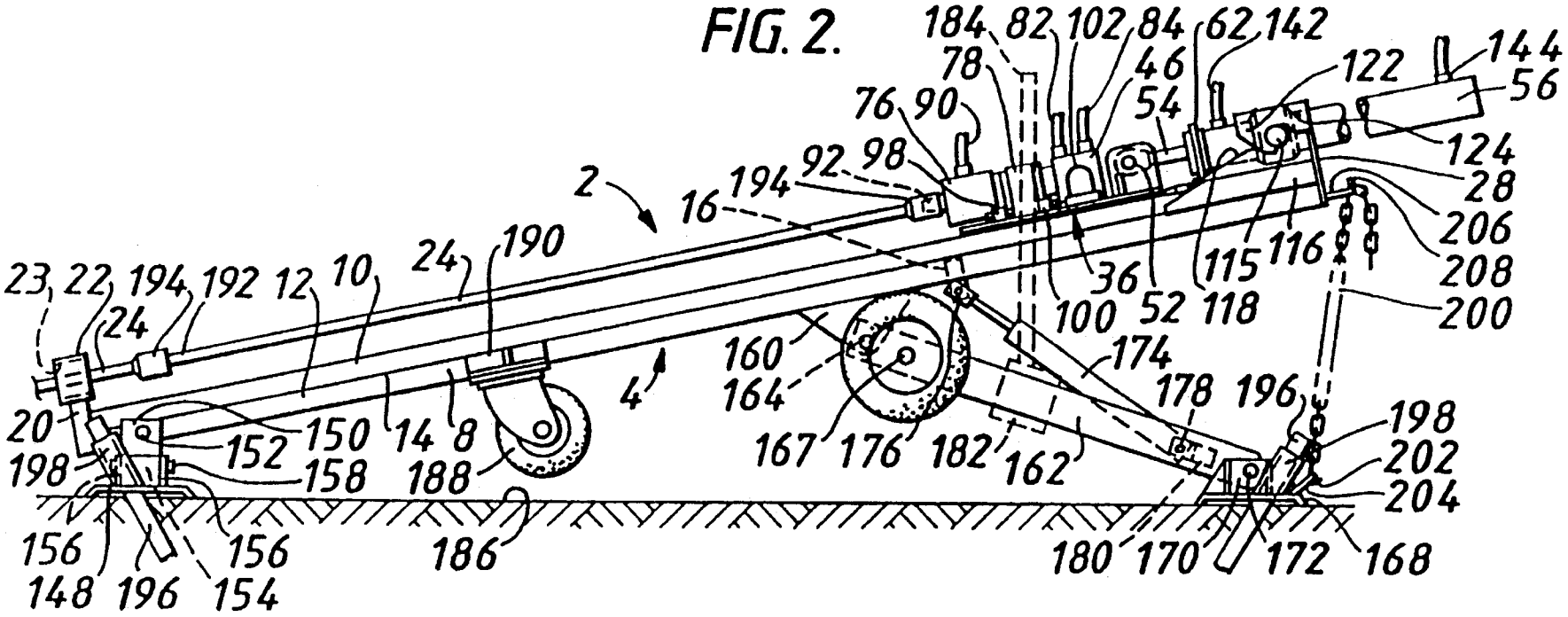
FIG. 2 is a side elevation of the mole launcher in FIG. 1 in an operating position.

As indicated in dotted lines a control and supply system 182 for controlling the supply of hydraulic pressure in the jack 174 is mounted on one of the legs 162. The system 182 can comprise a pump and control valve means. The pump can be operated by a manually actuable handle 184 to develop desired hydraulic pressure supplied to the jack 174 to extend the latter causing relative movement between the rear foot 168 and the rear end of the chassis 4 to increase the distance between them whereby the chassis can move from a position such as shown in FIG. 1 into an inclined position (front end of chassis 4 lowermost) such as shown in FIG. 2 with both feet 148,168 standing on a ground surface 186. The angle of inclination can be varied up to a maximum defined by the construction of the apparatus depending on how long the jack 174 is extended. The rear end of the chassis 4 can be lowered by contracting the jack 174 by using the valve means in the system 182 to relieve hydraulic pressure in the jack.

If desired (and as shown in FIGS. 1 and 2) two more wheels 188 (only one shown in FIG. 1 and 2) having a castor action can be mounted on a respective bracket 190 extending down from a respective side member 6 or 8 so that when the mole launcher 2 is in a transportation attitude such as shown in FIG. 1 it can stand on the four wheels 166,188 which afford it maneuverability, for example when being stowed in or retrieved from a transport vehicle or moved on its wheels running on the ground.

Figure 3:
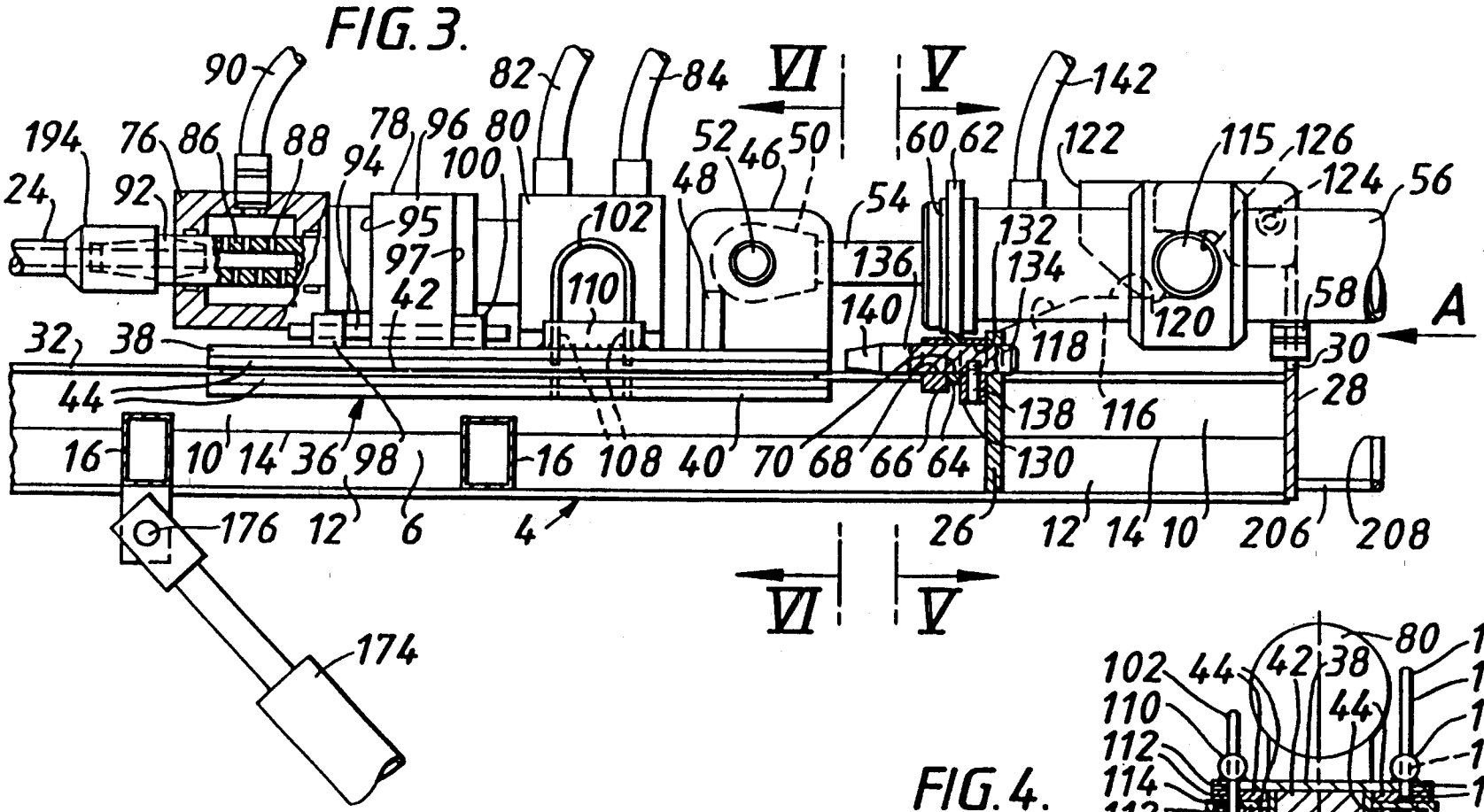
FIG. 3 is an enlarged view, with respect to FIGS. 1 and 2, partly in section of a fragment of a right-hand end part of the mole launcher in FIG. 2.

When the mole launcher 2 is to be used, it is brought to the site where it is desired to bore the passage. Often a pit is dug and from that the mole progresses below ground. The launcher 2 can stand on the ground surface 186 outside the pit, if desired, and be inclined at an appropriate angle (using the jack 174 and supply and control system 182) for feeding the string of drill pipes 24 into the bored passage after the mole connected to the leading end of the string. In preparation for use, and with the slide 36 at the front end of the chassis 4 locked thereto by means of the locking pins 102, hydraulic power is applied to the cylinder 56 to drive it rearwardly away from the slide 36 so that the trunnions 115 enter the trunnion bearings 120 to which the cylinder 36 is then locked by pivoting the latches 122 into their trunnion restraining position (shown in FIG. 2 and 3). Now the locking pins 102 are released from the chassis 4 and hydraulic power applied to the cylinder 56 to retract the connecting rod 54 whereby the slide 36 and drill head 76,78,80 are pulled towards the higher end of the chassis 4. The stroke of the piston in the cylinder 56 is substantially equal to or greater than a length of each rod 24 in the drill string. Each drill pipe 24 has an externally screw-thread leading end 192 and a trailing end 194 formed as a widened end connector 196 having an internal screw thread to which can be releasably threaded the leading end of the following drill pipe. The last drill pipe 24 in the string is arranged with its trailing end fitting through the guide 22 and extending a little way over the front end of the chassis 4. Now the leading end of the next drill pipe 24 to be used is screwed into the connector of the drill pipe in the guide 22 and the connector 194 of the new drill pipe is screwed onto the connecting tube 92 of the drill-head 76,78,80 adjacent to the new end of the chassis 4. Compressed air is now supplied in known manner through the air-box 76 to the pipe string to pneumatically actuate a percussive mole at the leading end of the string. Also the hydraulic motor 80 can be driven to give output torque rotating the connecting tube 92 and thus the pipe string and mole.

Hydraulic fluid pressure is supplied to the cylinder 56 in such manner as to extend the connecting rod 54 thus pushing the slide 36 and drill-head 76,78,80 along the chassis 4 down towards its front end. As a consequence the string of pipes 24 and the mole are subjected to pushing force. This can be considerable because it is derived from hydraulic pressure and because the linear thrust of the connecting rod 54 is transmitted rectilinearly substantially directly through the drill head to the drill rod string. The line of action of the connecting rod 54 and the longitudinal axis of the connecting tube 92 may, but need not be, the same straight line; they may for example be substantially parallel being spaced a short distance apart or be at an angle to one another.

Because the hydraulic thrust on the pipe string can be great there can be a tendency for the mole launcher 2 to shift over the ground due to reaction. To stop this movement, the feet 148 and 168 can be secured to the ground 186 by relatively long removable metal pegs 196 hammered thereinto through the feet. As can be seen in FIG. 2 the pegs 196 holding the front foot 148 are inclined downwards from the forward direction whereas the pegs 196 holding the rear foot 168 are inclined downwards from a rearward direction. Each foot 148,168 has two associated pegs 196 one adjacent each end of the foot. Each foot 148,168 has mounted thereon an open ended, inclined tube 198 coinciding with a respective opening through the foot. The pegs 196 are fitted into and guided by the tubes 198. The pegs 196 and tube 198 tend to act to hold the feet in place firmly relative to the ground because there is a better chance that peg and tube may make contact with each other at more than one point along their lengths and thus reduce the chance of the corresponding foot rocking about a single point of contact with the peg. Also to ensure a firm grip in the ground, the pegs 198 may each be formed of angle metal having, for example, an L-shaped cross-section.

The reaction to the hydraulic thrust on the drill pipe string also acts to widen the gap between the rear end of the chassis 4 and the rear foot 168 and so increase the tilt of the chassis. To oppose this a mechanical restraint is secured between the chassis 4 and the rear foot 168. In this example the restraint is a chain with a hook 202 at one end hooked to a U-shaped metal loop or eye 204 mounted on the rear foot 168 and secured to another U-shaped metal loop or eye 206 mounted on the rear of the chassis and having a peg 208 over which a chain link is removably fitted.

The hydraulic motor 80 may be stopped, when desired, whilst the connecting rod 54 is still pushing on the pipe string. It is known that by judiciously stopping rotation of the mole so that the mole stops in a chosen attitude relative to its axis of rotation it may be steered, by the effect of its continued percussive action, to ensure it follows a desired path when rotating; in this case the mole has a known wedge or chisel-shaped boring tool at its leading end.

On the slide 36 and drill-head 76,78,80 reaching the forward end of the chassis 4, the connecting rod 54 reaches the end of its stroke and pushing on the drill pipe string ceases. Now the connecting tube 92 is disconnected from the string and the slide 36 and drill-head 76,78,80 pulled back up to the rear end of the chassis by hydraulic retraction of the connecting rod 54 so that a new drill pipe 24 can be connected to the trailing end of the pipe string and to the connecting tube 92.

Because the drill-head 76,78,80 is movable back and forth some distance relative to the slide 36 by reason of being mounted on the rods 94 between the brackets 98,100, it can be moved to give either the requisite working room to allow a drill pipe 24 to be disconnected from the connecting tube 92 or the close proximity to allow a drill pipe to be connected to the connecting tube.

It will be appreciated that since the connecting tube 92 undergoes a reciprocating movement the launcher 2 can also be used to pull the drill pipe string and mole from the bored passage, the procedure being substantially the reverse operation to that described above.

When the operation of pushing or pulling on a string of drill pipes is completed or it is otherwise desired to pack-up the launcher, the slide 36 is returned to the forward end of the chassis 4 and locked thereto by using the locking pins 102, then the latches 122 are pivoted back to release the trunnions 115. Now hydraulic power applied to the line 142, the line 144 being used as an outlet, causes the cylinder 56 to retract along the chassis 4 in the forward direction until the length of the cylinder is substantially contained within the length of the chassis. Thus considerably shortening the launcher by comparison with its active length for pushing or pulling on drill pipes 24. So shortened, the launcher 2 is easier to handle and transport. The pegs 196 are pulled out of the ground and the valve means of the supply and control system 182 is operated to relieve the pressure in the jack 174 so that the legs 162 retract either under the weight of the launcher or automatically to allow the wheels 166, 188 to contact the ground. Also the chain 200 can be detached from the peg 208 and/or the eye 204.

Because an hydraulic cylinder 56 is used to apply thrust or pulling force to a string of drill pipes it is possible to selectively control the force used (connecting rod thrust = selected hydraulic pressure × piston area), and since the force is applied from the connecting rod 54 substantially directly and linearly to the pipe string, it is possible to select a desired force and be certain that it is substantially that desired force which the pipe string is experiencing. Also whilst the cylinder 56 and connecting rod 54 are acting on the pipe string by moving the slider 36, the slider is not supporting the cylinder 56 since that is supported and retained by the dowel 136 engaging the lock plate 62.

What is claimed is:

1. A mole launcher from which is propellable under fluid power a string of drill pipes having at a mole end of the string remote from the launcher a mole operable to bore an underground passage, said mole launcher comprising:

a double acting fluid powered piston and cylinder unit comprising a cylinder having a piston working therewithin and acting to reciprocate a connecting rod as said piston reciprocates, a support means for supporting said double acting fluid powered piston and cylinder unit, said cylinder being mounted on said support means and being capable of longitudinal movement relative to the support means, a connecting means for detachably connecting the connecting rod to a said drill pipe at a drive end of said drill pipe string when the launcher is in use and the mole is at the mole end of the string such that when the connecting rod performs linear strokes relative to the cylinder the linear movement of the rod is applied as linear movement to the drill pipe string which is pushed or pulled by said movement of the connecting rod, said cylinder being movable longitudinally relative to the support means between first and second positions, a first disengageable restraining means for holding the connecting rod substantially stationary relative to said support means whereby under fluid power the cylinder can be moved from said first position to said second position and vice-versa, a second disengageable restraining means for holding the cylinder substantially stationary longitudinally in said second position whereby under fluid power applied to the cylinder said connecting rod can be reciprocated relatively to the cylinder such that on an outward movement from the cylinder said connecting rod exerts pushing force on the string of drill pipes connected to the connecting rod in the course of use of the launcher, and wherein in said second position said cylinder projects beyond said support means and a disengageable engagement means is provided on the cylinder and said support means for supporting the cylinder and for restraining the cylinder from lifting away from said support means.

2. A mole launcher as claimed in claim 1, wherein the connecting rod emerges from a first end of said cylinder and in the second position an opposite second end of the cylinder projects beyond said support means, and wherein the disengageable engagement means comprises a dowel mounted on one of said support means and cylinder, and further comprising a member with an aperture mounted on the other of said cylinder and said support means for said dowel to engage in said aperture when the cylinder is one of in and near to said second position.

3. A mole launcher as claimed claim 1, in which the cylinder while moving between the first and second positions is slidably supported by a guide on the support means.

4. A mole launcher as claimed in claim 3, in which the guide comprises an anti-friction bearing.

5. A mole launcher as claimed in claim 1, in which the cylinder is provided with trunnions arranged to engage in trunnion bearings when the cylinder moves into said second position, said trunnion bearings are mounted on the support means, and a releasable latch means is provided for disengageably restraining the trunnions in said trunnion bearings.

6. A mole launcher as claimed in claim 5, in which each trunnion bearing is a notch having an open side to which a sloping surface leads for directing a said trunnion into said notch.

7. A mole launcher as claimed in claim 1, in which said connecting means for connection to a drill pipe is mounted on a slider slidably mounted on the support means, and said connecting rod is attached to the slider.

8. A mole launcher as claimed in claim 7, in which said connecting means is movable relative to the slider in opposite directions along which the slider is movable by said connecting rod.

9. A mole launcher as claimed in claim 8, in which the support means comprises runners on which the slider slides.

10. A mole launcher as claimed in claim 7, in which the slider is in sliding engagement with said support means.

11. A mole launcher as claimed in claim 8, in which a drill-head comprises said connecting means, the drill-head is mounted on the slider, and said drill-head is arranged to move relative to the slider in said opposite directions.

12. A mole launcher as claimed in claim 7, in which a means is provided for supplying compressed air to said connecting means such that compressed air is supplied to a said drill pipe when the latter is connected to said connecting means.

13. A mole launcher as claimed in claim 7, in which a means is provided for rotating the connecting means to rotate a said drill pipe when the latter is connected to the connecting means.

14. A mole launcher as claimed in claim 7, in which the first disengageable restraining means comprises a locking pin arrangement for engaging the slider and for disengageably engaging the support means.

15. A mole launcher as claimed in claim 1, in which the piston and cylinder unit is a hydraulic unit.

16. A mole launcher as claimed in claim 1, in which the support means is tiltable, relatively to a ground surface, by operation of a fluid pressure actuated jack.

17. A mole launcher as claimed in claim 16, provided with a detachable mechanical restraining means for opposing a widening of an angle at which the support means is tilted.

18. A mole launcher as claimed in claim 1 in which the support means is provided with at least one foot for standing on the ground.

19. A mole launcher as claimed in claim 18, in which said foot is provided with at least one tube for receiving a peg for driving into the ground.

20. A mole launcher as claimed in claim 19, in combination with a peg of angle metal.

21. A mole launcher as claimed in claim 1, provided with wheels for running on the ground.

22. A mole launcher as claimed in claim 18, in which said foot is mounted for pivoting about at least one axis.

23. A method of operating a mole launcher intended for at least pushing a string of drill pipes behind a mole boring a passage in the ground, said method comprising providing a mole launcher comprising a chassis on which is slidably mounted a drill head which is detachably attachable to said string, and a double acting hydraulic piston and cylinder unit slidably mounted on the chassis and having a connecting rod to pull and push said drill head, disengageably engaging the drill head with the chassis at a first position along the chassis by a disengageable first engaging means to hold the drill head at said first position, applying hydraulic pressure to said unit to move the cylinder along the connecting rod and chassis in a first direction to a second position along the chassis, said first and second positions being spaced apart, disengageably engaging the cylinder of said unit with the chassis at said second position wherein said cylinder projects beyond said chassis, moving the first engaging means to disengage the drill head from the chassis to allow the drill head to move from said first position, and applying hydraulic pressure to the unit to retract the connecting rod into the cylinder and move the drill head in the first direction along the chassis towards said second position.

24. A method as claimed in claim 23, in which, when said cylinder is disengageably engaged with the chassis at said second position, application of hydraulic pressure to the unit can extend the connecting rod from the cylinder and push the drill head in an opposite second direction towards the first position, and in so doing, can push on said string connected to the drill head.

25. A method as claimed in claim 23, in which when said cylinder is disengageably engaged with the chassis at said second position and the connecting rod is extended from said cylinder, application of hydraulic pressure to the unit to retract the connecting rod into the cylinder can pull on said string connected to the drill head.

26. A method as claimed in claim 24, in which, when said unit is in said second position, the cylinder projects by a greater part of its length beyond an end of the chassis.

27. A method as claimed in claim 26, in which, when the drill head is disengageably engaged in said first position and hydraulic pressure is applied to move the cylinder along the connecting rod in an opposite second direction from the second position towards said first position, the cylinder can be moved so that at least a major part of its length does not extend beyond said end.

28. A method as claimed in claim 23, in which the drill head is reciprocable along said chassis by hydraulic pressure applied to said unit by a stroke which is greater than or at least substantially equal to a length of a drill rod in or for said string.

* * * * *